US006126171A

United States Patent [19]

Vensland

[11] Patent Number: 6,126,171

[45] Date of Patent: Oct. 3, 2000

[54] SEALING CARTRIDGE

[75] Inventor: David G. Vensland, Champlin, Minn.

[73] Assignee: Hypro Corporation, St. Paul, Minn.

[21] Appl. No.: 09/047,250

[22] Filed: Mar. 24, 1998

Related U.S. Application Data

[60] Provisional application No. 60/043,043, Apr. 3, 1997.

[51] Int. Cl.[7] ..... F16J 15/26

[52] U.S. Cl. ..... 277/516; 277/510; 277/511

[58] Field of Search ..... 277/510, 511, 277/512, 514, 516, 518

[56] References Cited

U.S. PATENT DOCUMENTS 3,870,439 3/1975 Stachowiak et al. .
3,975,026 8/1976 Boyle et al. .
4,301,893 11/1981 St. Jean et al. ..... 277/516
4,379,557 4/1983 Saka ..... 277/516
4,758,135 7/1988 Woodward et al. .
4,819,950 4/1989 Winslow .
5,102,312 4/1992 Harvey .
5,409,350 4/1995 Mitchell .

*Primary Examiner*—Chuck Y. Mah
*Assistant Examiner*—Karlena D. Schwing
*Attorney, Agent, or Firm*—Nikolai, Mersereau & Dietz, P.A.

[57] ABSTRACT

An improved sealing cartridge for use in a reciprocating plunger pump which includes a low pressure seal, a vacuum seal, and an oil seal within a unitized cartridge assembly to facilitate servicing and/or replacing the various seals with minimal effort and which provides improved sealing characteristics to prevent the unwanted migration of oil, fluid, and air during both priming and normal operating conditions.

6 Claims, 4 Drawing Sheets

SEALING CARTRIDGE

I. Cross Reference to Related Application:

The application claims the benefit of U.S. Provisional Application No. 60/043,043, filed Apr. 3, 1997.

BACKGROUND OF THE INVENTION

II. Field of the Invention

The present invention relates generally to the field of reciprocating pumps. More particularly, the present invention relates to an improved sealing cartridge for use in a reciprocating plunger pump which includes a high pressure seal, a low pressure seal, a vacuum seal, and an oil seal within a unitized cartridge assembly to facilitate servicing and/or replacing the various seals with minimal effort, and which provides improved sealing characteristics to prevent the unwanted migration of oil, fluid, and air during both priming and normal operating conditions.

III. Discussion of the Prior Art

Plunger pumps may be characterized generally as including a plunger which reciprocates past a plurality of stationary seals so as to generate a pressurized fluid flow. A necessary evil with plunger pumps is that the reciprocating action of the plunger generates friction with the various seals which, consequently, causes the seals to experience deterioration over time. In addition, seals are constructed of material having finite strength and resiliency characteristics such that the seals invariably deteriorate due to continued exposure to pressurized fluid. Deterioration of the seals reduces their ability to perform as intended, namely to prevent the migration of fluid between the various parts within the pump. Among other problems, seal deterioration may allow the fluid being pumped to seep into the lubricating oil found in the crankcase, thereby raising the specter of damaging the crankcase and/or crankcase components. Seal deterioration may also allow air to seep into the pumping chamber. The flow of air into the pumping chamber may disadvantageously result in air-lock during priming operations, and may cause unwanted cavitation during normal operation which adversely affects pumping efficiency. These and other negative ramifications of seal deterioration require that the seals within plunger pumps be changed periodically.

FIG. 1 illustrates a plunger pump 10 typical of those employed in the prior art. The pump 10 includes a crankcase 12, a head assembly 14, and a reciprocating plunger assembly 16. The crankcase 12 includes an oil chamber 18, a guide chamber 20 for slidably receiving a plunger guide 22, and a drainage area 24 open to ambient. The head assembly 14 is two-piece in construction, including a first head member 26 and a second head member 28. Extending between the first head member 26 and the second head member 28 is a retainer 30 for forcibly maintaining a seal spreader 32 and a high pressure seal 34 within the second head member 28. The second head member 28 further includes a retaining slot for fixedly retaining a low pressure seal 36 therewithin. The plunger assembly 16 includes a reciprocating plunger 38 coupled to the plunger guide 22 via a retaining nut 40 and a crankshaft 42 rotatably coupled to the plunger guide 22 via a connecting rod 44. In order to prevent the migration of oil from the crankcase 12, a cartridge 46 is provided extending between the second head member 28 and the oil chamber 18 having an oil seal 48 for forming an oil-tight junction about the plunger guide 22 and a wiper member 50 for augmenting the sealing capability of the oil seal 48. In the event that oil does seep past the wiper member 50 and the oil seal 48, a plurality of weep holes 52 are formed in the cartridge 46 to allow any oil to drain out of the pump 10 by exiting through the drainage area 24. In order to prevent the unwanted migration of fluid from the head assembly 14, the seal spreader 32 is employed in conjunction with the high pressure seal 34 to form a fluid-tight junction with the plunger 38 which is capable of maintaining high fluid pressure within the head assembly 14. The low pressure seal 36 is also provided within the second head member 28 to maintain a low pressure fluid bath against the plunger 38 for the purpose of cooling the high pressure seal 34.

While the pump 10 may be considered as generally effective, close examination will elucidate that the pump 10 is nonetheless fraught with several formidable drawbacks. First and foremost, the pump 10 fails to provide the various seals in a readily accessible and conveniently removable fashion such that servicing operations, such as seal repair and/or replacement, are laborious and time consuming. Indeed, the low pressure seal 36 is disposed completely within the confines of the second head member 28, the seal spreader 32 and the high pressure seal 34 are force fit in between the retainer 30 and the second head member 28, while the oil seal 48 is disposed within the far end of the cartridge 46. In this arrangement, a service person must thus remove the first head member 26, the retainer 30, the second head member 28, and the cartridge 46 to avail all of the sealing members for maintenance or replacement. This is particularly disadvantageous in that it is burdensome and time consuming to dismantle this hose of pump parts every time the seals require servicing. The task of servicing is furthermore made difficult due to the fact that the low pressure seal 36 is effectively buried within the second head member 28 which, as will be appreciated, requires substantial effort to remove and replace the low pressure seal 36. Another significant disadvantage stems from the configuration of the cartridge 46. More specifically, the cartridge 46 extends entirely within the crankcase 12 such that it may be difficult to obtain an adequate purchase on the cartridge 46 to extract it from the force fit position within the crankcase 12, thereby increasing the difficulty in servicing the oil seal 48. In addition, the oil seal 48 is disposed within the cartridge 46 without any type of restraining element between the oil seal 48 and the drainage area 24. This arrangement disadvantageously presents a likelihood that the oil seal 48 will become dislodged during operation, such as from excess friction between the oil seal 48 and the plunger guide 22 or from an increase in oil pressure within the crankcase 12.

A still further drawback is that the sealing arrangement permits air to migrate from the drainage area 24 into the head assembly 14 during priming operations and negative pressure conditions at the fluid inlet 54. This stems from the fact that the low pressure seal 36 is incapable of forming an adequate seal about the plunger 38 during such conditions. To further explain, the low pressure seal 36 is a standard U-cup which forms a unidirectional seal along the plunger when properly energized or expanded. The necessary energization occurs when low pressure fluid is allowed to flow between the low pressure seal 36 and the high pressure seal 34 such that the U-cup expands inwardly and envelops the plunger 38 to form a seal therealong. While the low pressure seal 36 is effective in minimizing the degree to which low pressure fluid may seep into the drainage area 24 when properly energized, air will nonetheless flow inwardly past the low pressure seal 36 during priming operations due to the fact that there is little or no fluid pressure to adequately bias the low pressure seal 36 against the plunger 38. This increases the likelihood of producing an air-lock condition within the head assembly 14 which may inhibit or altogether thwart priming operations within the pump 10. Negative pressure conditions at the fluid inlet 54 may occur, for example, when the fluid reservoir supplying coupled to the fluid inlet 54 is disposed below the pump 10. Such negative pressure also acts upon the low pressure seal 36 in that the fluid inlet 54 is coupled to the channel defined between the high and low pressure seals 34, 36. Negative pressure at the low pressure seal 36, in turn, causes the low pressure seal 36 to lose its charge such that air may be drawn therepast into the fluid inlet 54 and ultimately into the head assembly 14. During operation, such an influx of air into the fluid inlet 54 may cause cavitation which, as will be appreciated, adversely affects the efficiency and life expectancy of the pump 10.

In view of the foregoing deficiencies in the prior art, a need therefore exists for an improved seal arrangement within a plunger pump wherein all of the seals are maintained within a unitized cartridge assembly which is readily accessible and easily extractable for facilitating servicing operations. A further need exists for an improved seal arrangement wherein all of the seal members may be easily removed from a unitized cartridge assembly so as to minimize the effort in replacing the seals following removal of the cartridge assembly from the pump. A still further need exists for an improved seal arrangement wherein the oil seal is fixedly retained within the unitized cartridge assembly such that the oil seal will not become dislodged during operation due to excess friction between the oil seal and the plunger guide or from an increase in oil pressure within the crankcase. A yet further need exists for an improved sealing arrangement for a plunger pump which provides the ability to prevent airlock conditions during priming operations and cavitation due to negative pressure conditions at the fluid inlet during normal operation.

OBJECTS AND SUMMARY OF THE INVENTION

Accordingly, it is a primary object of the present invention to produce an improved seal arrangement within a plunger pump wherein a majority of the seals are maintained within a unitized cartridge assembly which is readily accessible and easily extractable for facilitating servicing operations.

It is a still further object of the present invention to provide an improved seal arrangement within a plunger pump wherein a majority of the seal members may be easily removed from a unitized cartridge assembly so as to minimize the effort in replacing the seals following removal of the cartridge assembly from the pump.

It is yet another object of the present invention to provide an improved seal arrangement wherein the oil seal is fixedly retained within the unitized cartridge assembly such that the oil seal will not become dislodged during operation due to excess friction between the oil seal and the plunger guide or from an increase in oil pressure within the crankcase.

It is a still further object of the present invention to provide an improved sealing arrangement for a plunger pump which provides the ability to prevent air-lock conditions during priming operations and cavitation due to negative pressure conditions at the fluid inlet during normal operation.

These and further objects and advantages of the present invention will be readily apparent to those skilled in the art from a review of the following detailed description of the preferred embodiment in conjunction with the accompanying drawings.

DETAILED DESCRIPTION OF THE PREFERRED EMBODIMENTS

Figure 1:
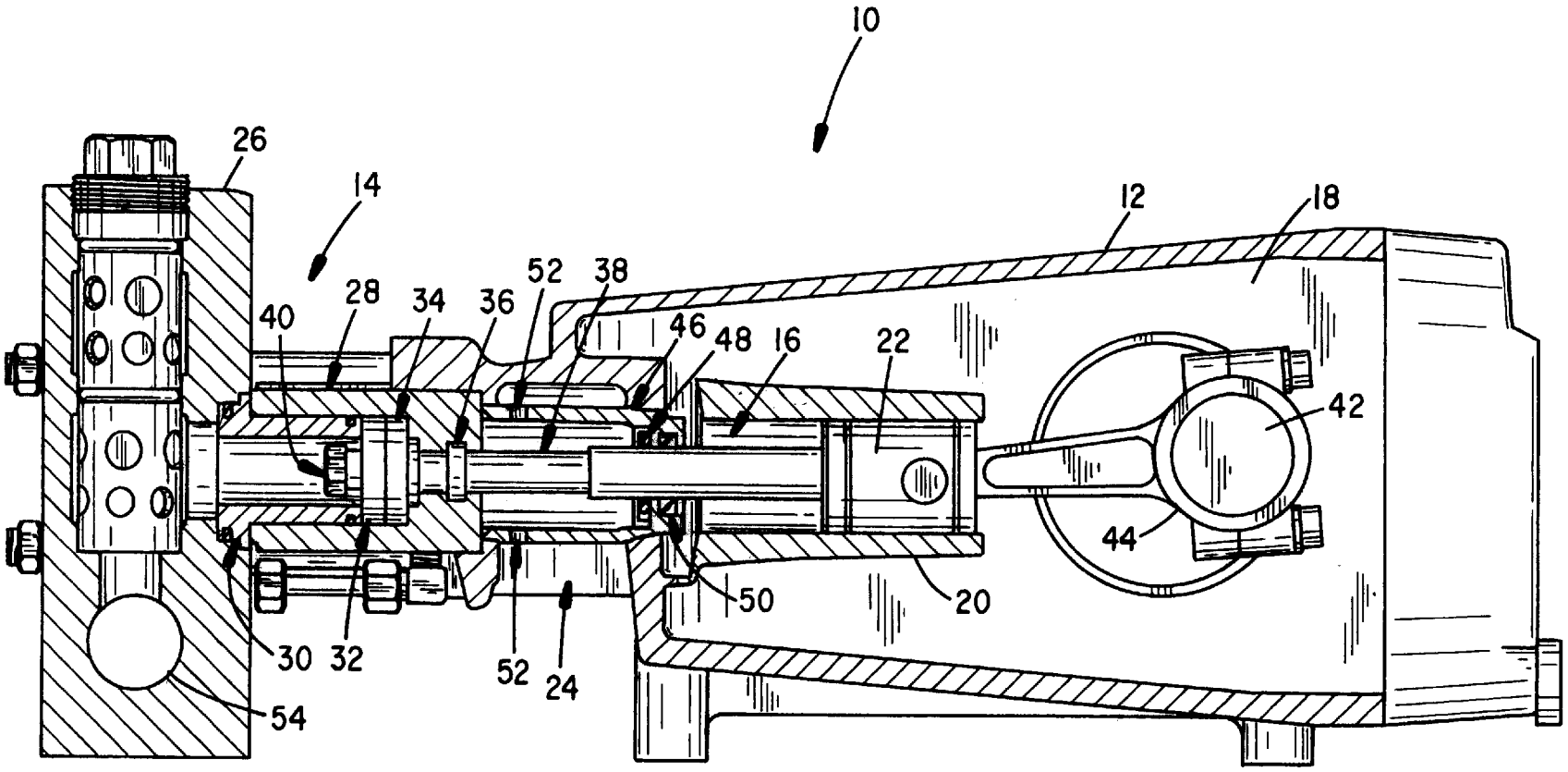
FIG. 1 (PRIOR ART)
FIG. 1 is a partial sectional view of a prior art plunger pump.
Figure 2:
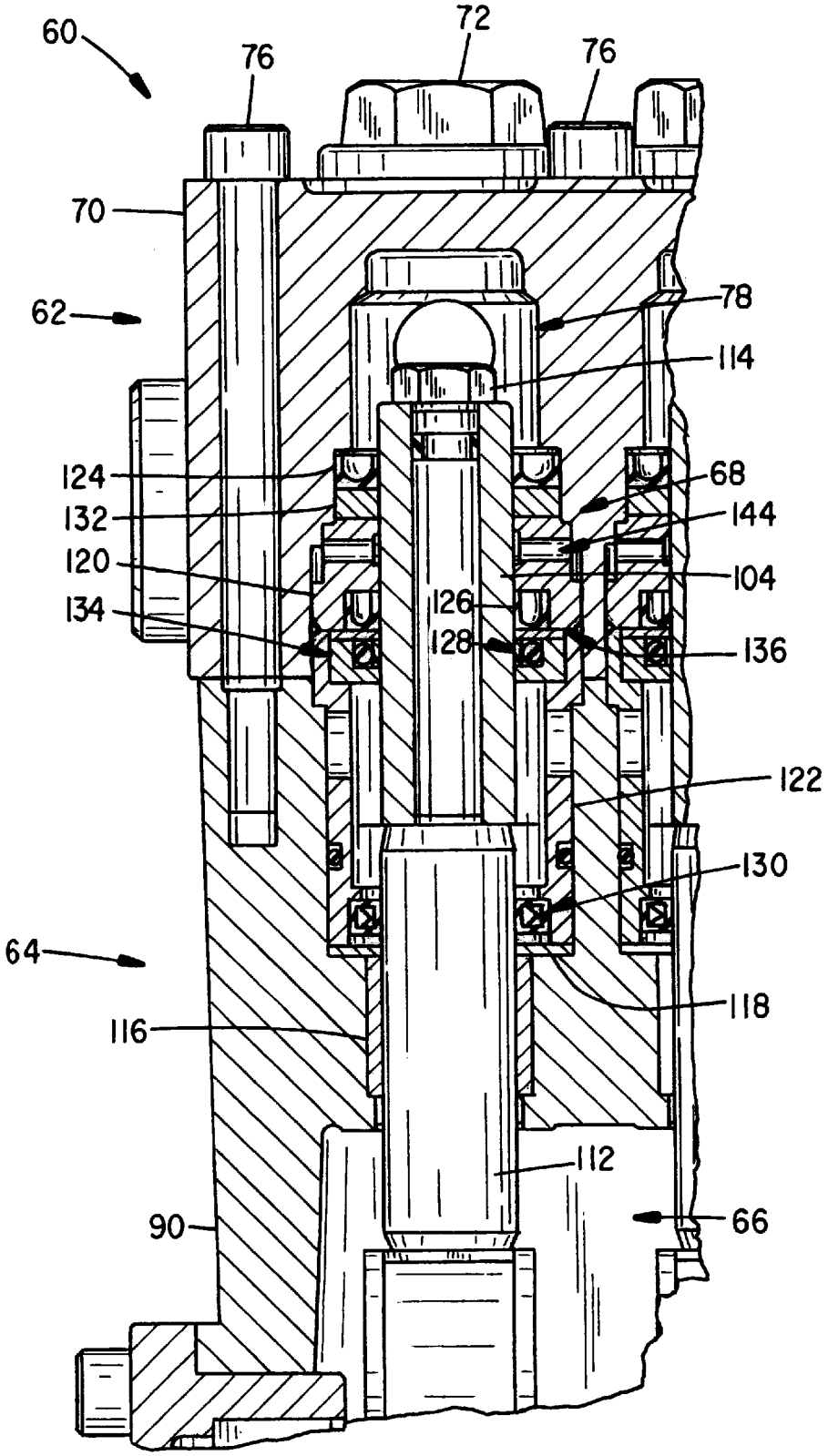
FIG. 2 is a partial sectional view of one cylinder of a plunger pump incorporating an improved sealing cartridge assembly of the present invention.
Figure 3:
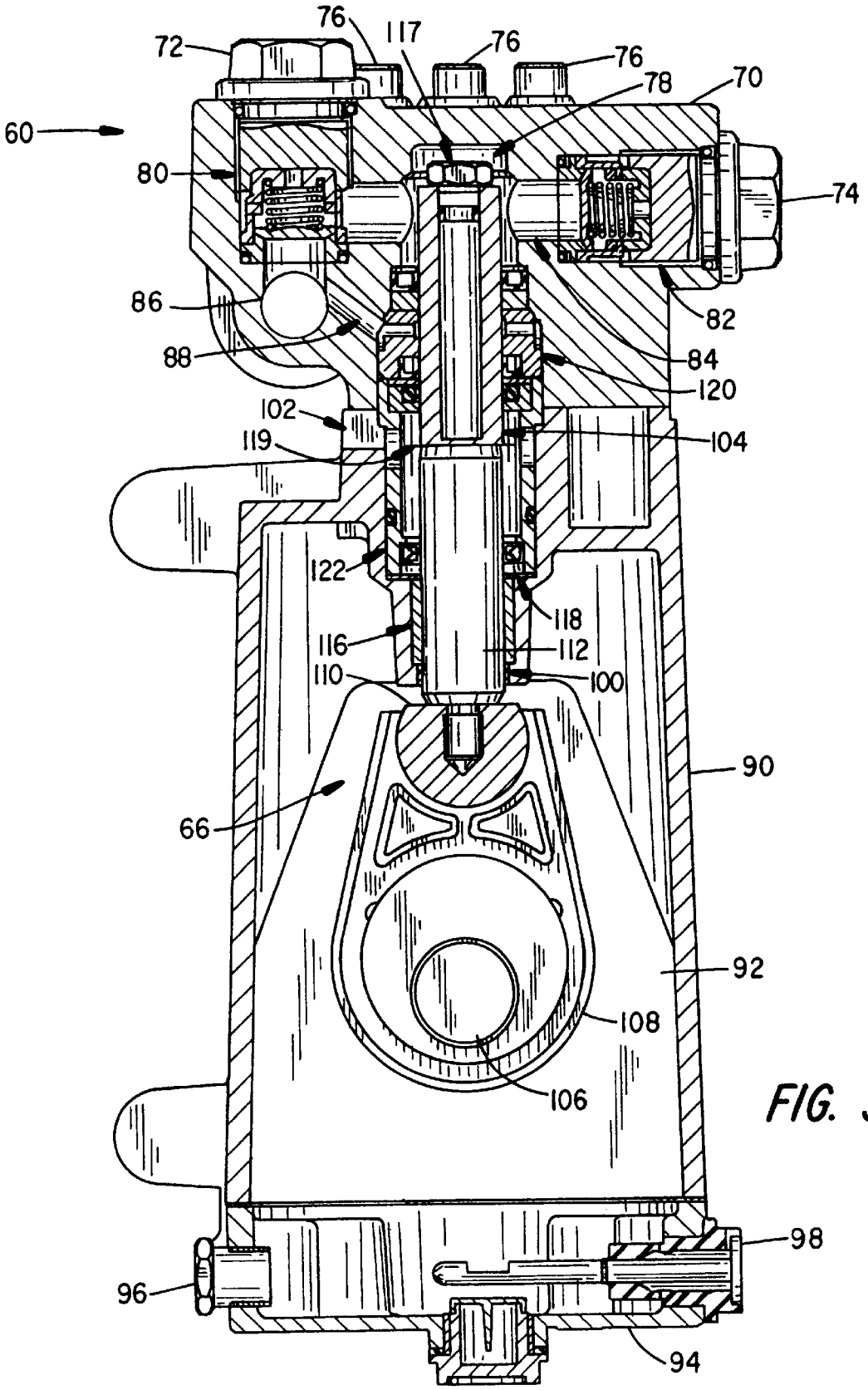
FIG. 3 is a partial sectional view of the plunger pump shown in FIG. 2, further detailing the improved sealing cartridge assembly of the present invention.

Referring initially to FIGS. 2 and 3, shown in partial cross section is one cylinder of a multi-cylinder plunger pump 60. The pump 60 includes a head assembly 62, a crankcase assembly 64, a reciprocating plunger assembly 66, and an improved sealing cartridge assembly 68 provided in accordance with a preferred embodiment of the present invention. The head assembly 62 includes a head member 70, an inlet valve 72, an outlet valve 74, and a plurality of head bolts 76 for connecting the head member 70 to the crankcase assembly 64. The head member 70 includes a pumping bore 78, an inlet valve bore 80, an outlet valve bore 82, a cross bore 84 extending between the inlet and outlet valve bores 80, 82, a fluid inlet bore 86 extending to inlet valve 72, and an irrigation bore 88 extending from the fluid inlet bore 86 into the pumping bore 78. The crankcase assembly 64 includes a crankcase housing 90 having an oil chamber 92 and an end cover 94 having an oil plug 96 and a dipstick assembly 98. The crankcase housing 90 is configured to include a through bore 100 which extends between the oil chamber 92 and the head member 70, and a drainage aperture 102 open to ambient. The reciprocating plunger assembly 66 includes a ceramic plunger 104, a crankshaft 106 having a connecting rod 108 and a wrist pin 110 coupled thereto, and a plunger guide 112 coupled to the plunger 104 and the connecting rod 108 via a retaining nut 114 and the wrist pin 110, respectively. A guide member 116, preferably constructed from carbon, is disposed within the through bore 100 of the crankcase housing 90 for facilitating the reciprocating movement of the plunger guide 112. A washer member 118 is furthermore provided for maintaining the guide member 116 in position within the through bore 100 of the crankcase 90. The plunger assembly 66 also includes a flinger washer 119 disposed between the plunger 104 and the plunger guide 112 which serves to deflect any fluid leakage away from the oil chamber 92 and provides a cushioning function between the plunger 104 and the plunger guide 112.

Figure 4:
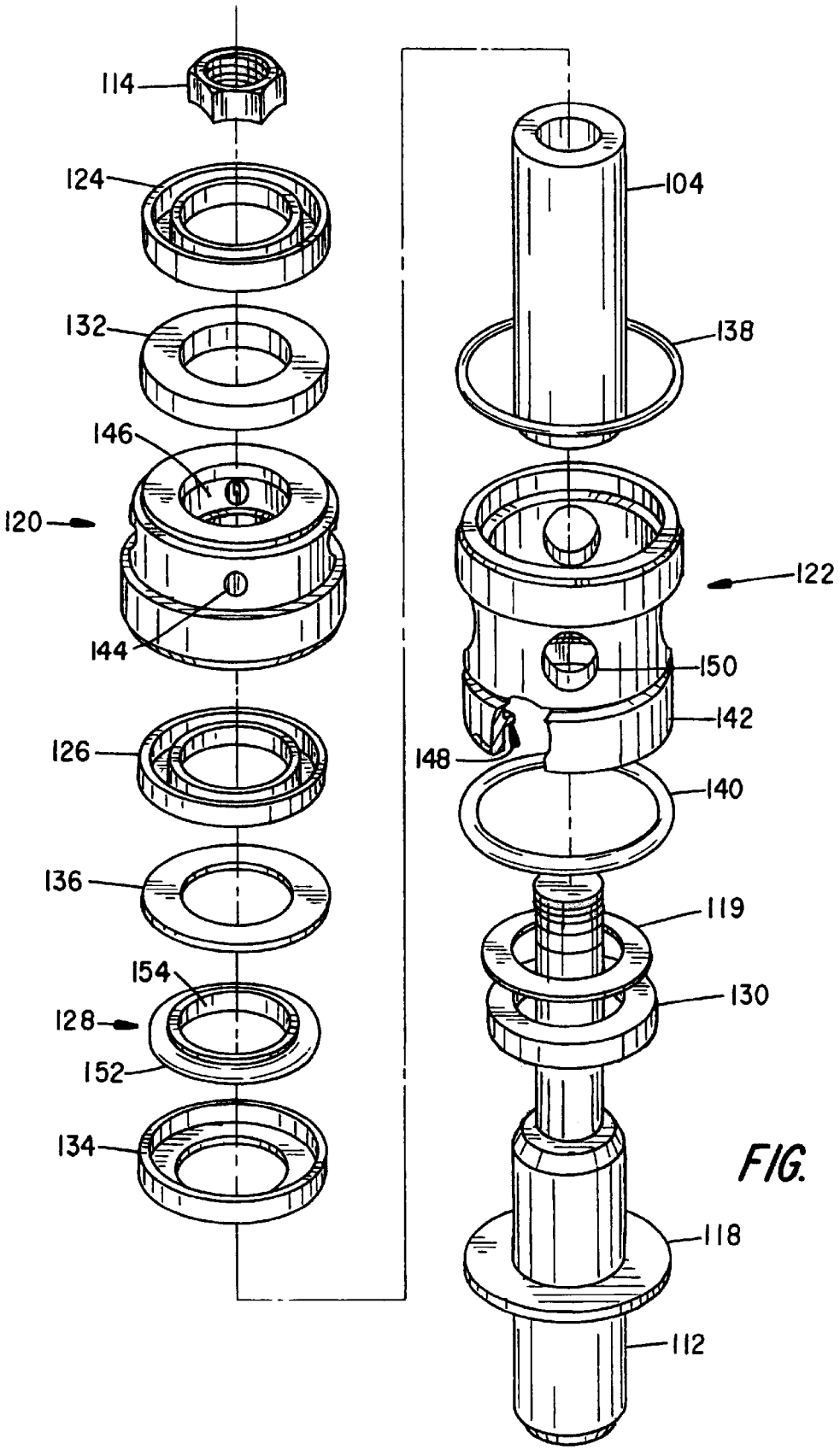
FIG. 4 is an exploded perspective view of the improved sealing cartridge assembly of the present invention.

With further reference to FIG. 4, the sealing cartridge assembly 68 of the present invention includes an upper cartridge member 120, a lower cartridge member 122, a high pressure seal 124, a low pressure seal 126, a vacuum seal 128, and an oil seal 130. In a preferred embodiment, an anti-extrusion member 132 may be further provided between the high pressure seal 124 and the top surface of the upper cartridge member 120 for pre-loading the high pressure seal 124 and providing a cushion between the high pressure seal 124 and the top surface of the upper cartridge member 120. A retainer member 134 and a washer member 136 may also be provided to maintain the vacuum seal 128 in an appropriate position for establishing an airtight junction with the plunger 104 so as to combat the influx of air during priming operations and periods of negative pressure conditions at the fluid inlet 86 during normal operation. An O-ring 138 may be optionally provided in between the upper and lower cartridge members 120, 122 to minimize any leakage which may occur when the upper and lower cartridge members 120, 122 are coupled together during operation. A still further O-ring 140 may be provided for placement within an O-ring groove 142 formed within the lower cartridge member 122 such that the lower cartridge member 122 may be force fit within the crankcase 90 to provide another seal between the lower cartridge member 122 and the through bore 100 of the crankcase housing 90.

The upper cartridge member 120 includes a plurality of flow apertures 144 and an internally disposed flow channel 146 which cooperate with the irrigation bore 88 within the head member 70 to provide a low pressure fluid bath for cooling the high pressure seal 124 during operation. Moreover, the upper cartridge member 120 is specifically recessed to provide a convenient housing for the low pressure seal 126 such that the low pressure seal 126 may be easily and quickly inserted into and removed from the upper cartridge member 120 during servicing operations. The lower cartridge member 122 includes a retaining lip 148, a plurality of weep holes 150, and the O-ring groove 142. The retaining lip 148 forms an important aspect of the present invention in that it serves to retain the oil seal 130 in position proximate to the retainer 118 during operation. Retaining the oil seal 130 in this fashion is particularly important in that the oil seal 130 cannot become dislodged due to excess friction from the reciprocating plunger guide 112 and/or overpressure conditions which develop within the oil chamber 92. The weep holes 150 cooperate with the drainage aperture 102 formed in the crankcase housing 90 to allow any fluid and/or oil which leaks past the vacuum seal 128 and/or the oil seal 130 to flow out to atmosphere. This effectively isolates the oil within the crankcase 90 from the fluid within the head member 70 so as to minimize the potential of pump damage due to commingling. In an important aspect of the present invention, the lower cartridge member 122 is also specifically designed to extend into the head member 70 when fully inserted into the through bore 100. This advantageously provides an adequate purchase area on the lower cartridge member 122 such that a service person may quickly and easily remove the lower cartridge member 122 to avail the vacuum seal 128, the oil seal 130, and the O-ring 140 for inspection and/or replacement.

The high pressure seal 124 is a standard U-cup which, when energized or expanded, envelops the plunger so as to form a fluid-tight junction therewith. In a preferred embodiment, the high pressure seal 124 is capable of withstanding pressures of up to 3,000 to 4,000 p.s.i. so as to support a wide range of applications and operating pressures. The low pressure seal 126 is also a standard Ucup, however, its main function is to provide a fluid-tight junction a predetermined distance below the high pressure seal 124 so as to provide a bath of low pressure fluid against the high pressure seal 124 for cooling purposes. The vacuum seal 128 comprises an O-ring 152 disposed about a sealing cylinder 154. In an important aspect, the O-ring 152 cooperates with the sealing cylinder 154 to bias the sealing cylinder 154 inward so as to prevent the passage of air from the drainage aperture 102 to the fluid inlet or irrigation bores 86, 88. The oil seal 130 may comprise any number of commercially available oil seals and is provided to prevent the leakage of oil from the oil chamber 92 into the drainage aperture 102. In a preferred embodiment, however, the oil seal 130 includes an outer plastic portion having a generally square cross section which encompasses an internally disposed garter spring to resiliently bias the plastic portion against the plunger guide 112, thereby preventing the influx of oil from the oil chamber 92.

From the foregoing, it should now be recognized that an improved seal arrangement been advantageously provided herein for maintaining all of the seals within a unitized cartridge assembly which is readily accessible and easily extractable for facilitating servicing operations. In particular, the upper and lower cartridge members 120, 122 can be easily accessed by simply removing the head bolts 76 from the head member 70 so as to dismantle the head assembly 62 from the crankcase assembly 64. At this point, a user may simply pull the upper cartridge member 120 over the plunger 104 to thereby gain access to the high pressure seal 124, the anti-extrusion ring 132, the low pressure seal 126, and the washer member 136 disposed above the vacuum seal 128. If desired, the lower cartridge member 122 may also be easily extracted by simply sliding the lower cartridge member 122 over the plunger guide 112 to thereby remove the vacuum seal 128 (and the accompanying retainer 134 and washer 136) as well as the oil seal 130 for inspection and/or service. The improved seal arrangement is also advantageous in that all of the seal members may be easily removed from the unitized cartridge assembly so as to minimize the effort in replacing the seals following removal of the cartridge assembly from the pump. Namely, the high pressure seal 124, the antiextrusion ring 132, the low pressure seal 126, the vacuum seal 128, the oil seal 130, and all other sealing components or parts may be removed with relative ease once the upper and lower cartridge members 120, 122 are removed from the pump 60. This, once again, serves the vital interest of servicing such seals in the quickest and most expedient fashion.

The improved seal arrangement of the present invention furthermore ensures that the oil seal 130 will not become dislodged during operation, such as during periods of excess friction with the plunger guide 112 and/or when excessive pressure develops within the crankcase 90. As noted above, this particular feature of the present invention stems from the formation of the retaining lip 148 on the lower cartridge member 122 which effectively locks the oil seal 130 in place about the plunger guide 112 proximate to the retainer member 118 during use. The cooperate action of the sealing cylinder 154 and the O-ring 152 also advantageously provides the ability to prevent air-lock conditions during priming operations and cavitation due to negative pressure conditions at the fluid inlet during normal operation.

A still further advantage exists with regard to aligning the head assembly 62 to the crankcase assembly 64 during assembly. Namely, the advantage resides in the manner in which the lower cartridge member 122 extends past the plane of the crankcase housing 90 when fully disposed within the through bore 100. This resulting overhand advantageously provides an automatic alignment tool when assembling the head assembly 62 to the crankcase assembly 64 in that the pumping bore 78 within the head member 70 is automatically forced into alignment with the through bore 100 extending from the oil chamber 92 toward the head assembly 62. This advantageously decreases the degree to which the plunger 104 is subject to side loading during such assembly operations. Moreover, the upper and lower cartridge members 120, 122 automatically align all of the seals and related components in a concentric fashion so as to readily receive the plunger 104 and the plunger guide 112 therewithin during assembly.

The preferred apparatus embodiments depicted herein are exemplary and numerous modifications, dimensional variations, and rearrangements can be readily envisioned to achieve an equivalent result, all of which are intended to be embraced within the scope of the present invention.

What is claimed is:

1. In a plunger pump of the type including a crankcase member, a head member affixed to the crankcase member, the crankcase member including a guide segment defining a first longitudinal bore and said head member including a second longitudinal bore, coaxial with the first longitudinal bore of the crankcase member, a piston plunger disposed in the first and second longitudinal bores and coupled by a connecting rod to a rotatable crank for reciprocating motion in the first and second longitudinal bores, an improved sealing cartridge assembly, comprising:

(a) an upper tubular cartridge member removably contained within the second longitudinal bore, there being an annular cavity in a base portion of the upper tubular cartridge member for containing an annular low pressure seal therein for cooperating with the piston plunger;

(b) a lower tubular cartridge member removably contained within the first longitudinal bore, the lower tubular cartridge having a counter bore in opposed ends thereof;

(c) retainer means disposed in the counter bore in one of the opposed ends for retaining an annular vacuum seal member therein concentric with the piston plunger; and (d) an annular oil seal disposed in the counter bore in the other end of the lower cartridge member in surrounding relation to the piston plunger.

2. The plunger pump of claim 1 and further including a plurality of flow apertures extending radially through the upper tubular cartridge member for permitting a cooling fluid to flow therethrough onto the piston plunger.

3. The plunger pump of claim 1 and further including a plurality of weep holes extending radially through the lower tubular cartridge for permitting lubricating fluid contained in the crankcase member that may bypass the annular oil seal to drain out of the crankcase member to the atmosphere.

4. The plunger pump of claim 1 wherein the vacuum seal member comprises:

an annular cylindrical sealing sleeve surrounding the piston plunger and an O-ring surrounding the annular cylinder sealing sleeve.

5. The plunger pump of claim 1 and further including a high pressure cup seal member disposed in the cylindrical bore in the head member and retained in place by the upper tubular cartridge member.

6. The plunger pump of claim 5 and further including an anti-extrusion ring concentrically surrounding the piston plunger and disposed between the high pressure cup seal member and the upper tubular cartridge member.

* * * * *